US006840391B2

(12) United States Patent
Miller et al.

(10) Patent No.: US 6,840,391 B2
(45) Date of Patent: Jan. 11, 2005

(54) ROLL OF PRODUCT HAVING PARALLEL DISPLAY STRIPS THEREON

(75) Inventors: Thomas R. Miller, South Haven, MI (US); William J. Hale, Stevensville, MI (US)

(73) Assignee: Tower Tag & Label LLC, St. Joseph, MI (US)

( * ) Notice: Subject to any disclaimer, the term of this patent is extended or adjusted under 35 U.S.C. 154(b) by 16 days.

(21) Appl. No.: 10/291,918

(22) Filed: Nov. 11, 2002

(65) Prior Publication Data

US 2004/0089622 A1 May 13, 2004

(51) Int. Cl.[7] ..... A47F 5/08

(52) U.S. Cl. ..... 211/113; 211/59.2; 242/160.4

(58) Field of Search ..... 211/59.2, 72, 113; 242/160.4, 159, 173; 206/411, 389; 428/41.8, 40.1, 42.2, 42.3, 43, 906; 414/904

(56) References Cited

U.S. PATENT DOCUMENTS

| | | | | | |
|---|---|---|---|---|---|
| 2,272,623 | A | | 2/1942 | Runner | |
| 2,381,605 | A | * | 8/1945 | Leander | 206/447 |
| 2,681,732 | A | * | 6/1954 | Brady | 206/447 |
| 2,797,801 | A | * | 7/1957 | Bishop, Jr. | 206/447 |
| 3,226,862 | A | * | 1/1966 | Gabruk | 40/638 |
| 3,615,992 | A | * | 10/1971 | Jeffries et al. | 156/154 |
| 3,885,070 | A | * | 5/1975 | Chapman | 428/42.3 |
| 4,055,249 | A | * | 10/1977 | Kojima | 206/447 |
| 4,317,852 | A | * | 3/1982 | Ogden | 428/40.1 |
| 4,496,628 | A | * | 1/1985 | Deatcher et al. | 428/337 |
| 4,654,991 | A | * | 4/1987 | Jones | 40/617 |
| 4,817,805 | A | * | 4/1989 | Rodriquez | 211/85.15 |
| 5,262,216 | A | * | 11/1993 | Popat et al. | 428/41.3 |
| 5,284,259 | A | | 2/1994 | Conway et al. | |
| 5,366,777 | A | | 11/1994 | Bown et al. | |
| 5,405,022 | A | | 4/1995 | Rissley | |
| 5,415,370 | A | | 5/1995 | Valiulis | |
| 5,553,721 | A | | 9/1996 | Gebka | |
| 5,582,433 | A | * | 12/1996 | Sisson | 283/81 |
| 5,664,682 | A | | 9/1997 | Eren | |
| 5,967,341 | A | | 10/1999 | Werner | |
| 6,006,929 | A | * | 12/1999 | Leonard | 211/113 |
| 6,109,582 | A | * | 8/2000 | Repaci et al. | 248/317 |
| 6,177,163 | B1 | * | 1/2001 | Blok et al. | 428/40.1 |
| 6,213,316 | B1 | | 4/2001 | Gretz | |
| 6,405,778 | B1 | * | 6/2002 | Belt | 156/519 |
| 6,428,221 | B1 | * | 8/2002 | Dolce et al. | 400/238 |
| 6,511,725 | B1 | * | 1/2003 | Rawlings | 428/40.1 |
| 6,673,188 | B1 | * | 1/2004 | Nakagawa | 156/248 |
| 2001/0036524 | A1 | * | 11/2001 | Anderson | 428/40.1 |
| 2003/0154569 | A1 | * | 8/2003 | McKay | 15/104.002 |
| 2003/0234305 | A1 | * | 12/2003 | Cole | 242/160.1 |

* cited by examiner

*Primary Examiner*—Carl D. Friedman
*Assistant Examiner*—Jennifer E. Novosad
(74) *Attorney, Agent, or Firm*—Price, Heneveld, Cooper, DeWitt & Litton

(57) ABSTRACT

A display strip for packages includes an elongated backing member and transverse adhesive strips that extend completely across the backing member for adheringly holding individual packages. A plurality of the display strips are adhered transversely to a roll of release paper in a side-by-side arrangement. This allows the adhesive strips to form a substantially continuous strip of adhesive running parallel the length of the roll, and also allows the display strips to be presented one by one as the roll is unwound a short distance equal to a width of the display strips. Due to the short distance of the roll as it is unwound, the display strips are easily removed one at a time off an end of the roll.

17 Claims, 2 Drawing Sheets

ROLL OF PRODUCT HAVING PARALLEL DISPLAY STRIPS THEREON

BACKGROUND

The present invention relates to display strips, and methods of attaching items to the display strip, including handling the display strip itself.

The industry of making display strips is highly competitive, and attempts to efficiently and effectively handle packages are often made, both in terms of reducing the cost and volume of components and in terms of handling, thus improving the ability to automate. Despite these efforts, assembly of packages to display strips continues to be very manually intensive. This is due in large part to the fact that display strips are long, narrow, and flimsy, making them difficult to handle and difficult to attach items to. Some display strips include multiple ways to attach the display strip to a wall or end panel of a shelf system, resulting in redundancy and wasted unused features in the display strips. Another aggravation is that, where high quality display strips are supplied by a product sales company to retail stores, the retail stores reuse the display strip to support and display competitive product.

Accordingly, a display strip, a strip delivery and attachment system, and a way of reducing misuse of "spent" display strips are desired, including means to solve the aforementioned problems and having the aforementioned advantages.

SUMMARY OF THE PRESENT INVENTION

In one aspect of the present invention, a display strip for packages of consumer products includes an elongated backing member with an aperture near one end and having a length and edges. The display strip further includes a plurality of adhesive strips on the backing member that extend transversely completely across the backing member between the edges at predetermined locations along the length. Packages are attached to the adhesive strip, with the adhesive strips having an adhering strength sufficient to releasably but reliably hold individual ones of the packages.

In another aspect of the present invention, a product includes a roll of release paper having a length and edges, and a plurality of elongated display strips each including an elongated backing member and a plurality of spaced-apart transverse adhesive strips thereon. The plurality of elongated display strips extend transversely across the length of the roll with the adhesive strips engaging the release paper and being positioned side-by-side. This allows the adhesive strips to form a substantially continuous strip of adhesive running parallel the length of the roll, and also allows the display strips to be presented one by one as the roll is unwound a distance equal to a width of the display strips. Due to the short distance of the roll as it is unwound, it allows the display strips to be easily removed one at a time off an end of the roll.

In another aspect of the present invention, a method comprises steps of providing a roll of release paper having a length and edges, with a plurality of transversely oriented display strips adhered to the roll of release paper by adhesive material, and providing a holder having several spaces for receiving individual packages and having a flat platform positioned to support a top flap of the individual packages. The method includes positioning individual packages in each of the several spaces, advancing the roll a short distance about equal to a width of one of the display strips, and removing one of the display strips. The method further includes positioning the one display strip over the holder with the adhesive material aligned with the flaps of the individual packages in the holder, and attaching the individual packages to the display strip by automatically engaging the adhesive material with each of the flaps.

These and other aspects, objects, and features of the present invention will be understood and appreciated by those skilled in the art upon studying the following specification, claims, and appended drawings.

DESCRIPTION OF PRIOR ART

Figure 4A:
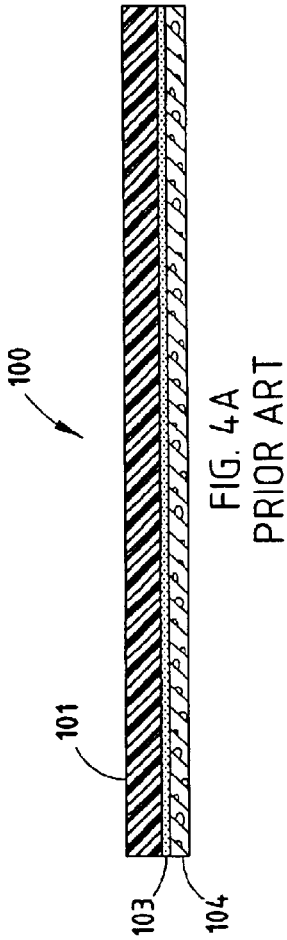
FIG. 4A PRIOR ART
Figure 4:
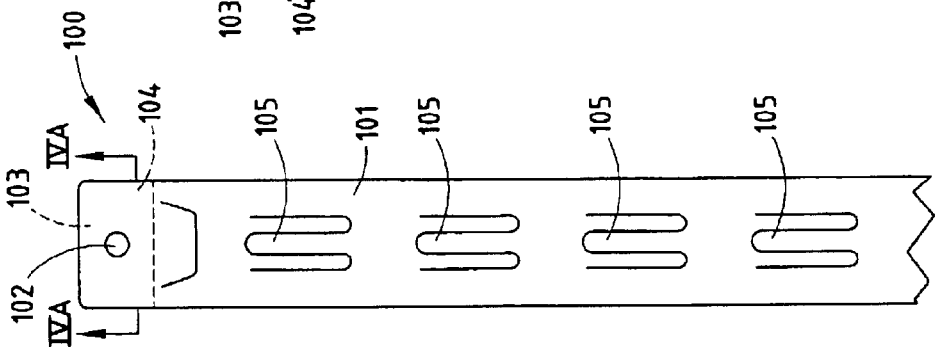
FIG. 4 PRIOR ART

The prior art display strip 100 (FIGS. 4 and 4A) includes a backing member 101 of clear material, a hole 102 in its top for hanging on a bracket, and an adhesive patch 103 covered with release paper 104. The adhesive patch 103 surrounds the hole 102 and can be used instead of the hole 102 for attachment to a wall or end panel of a shelving unit. A plurality of slits form fingers 105 that can be tipped out for hanging product on the display strip 100. However, it is sometimes difficult and frustrating to pick at and pull out the fingers. Further, the fingers do not reliably hold product, since the fingers bend and/or the product can slip up and off the fingers 105.

Figure 5:
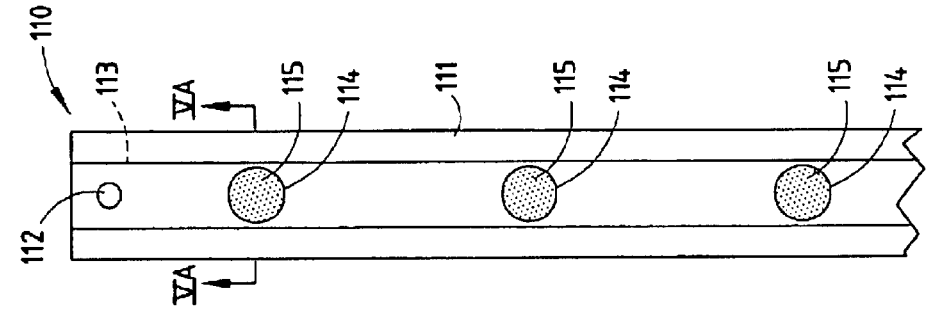
FIG. 5 PRIOR ART
FIGS. 4, 4A, 5, and 5A are plan views of prior art display strips.
Figure 5A:
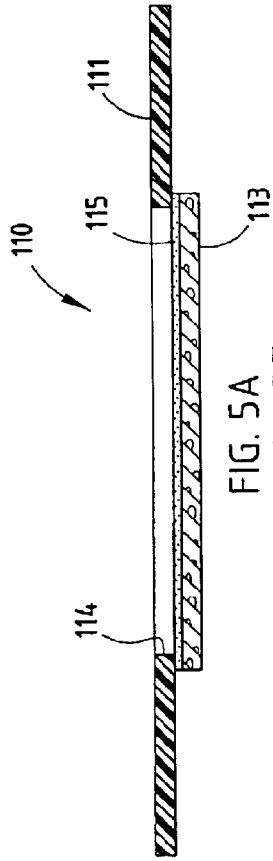
FIG. 5A PRIOR ART

The prior art display strip 110 (FIGS. 5 and 5A) includes a backing member 111 of clear material, a hole 112 in its top for hanging on a bracket, and a narrow strip of tape 113 extending vertically and adhered to a rear surface of the backing member 111. The backing member 111 has a plurality of spaced holes 114 along its length, exposing circular buttons 115 of adhesive material on the tape 113 to a front side of the backing member. However, a problem is that the tape 113 is expensive, and substantial amounts of the tape 113 are wasted since a majority of the tape is behind the backing member and not exposed. Also, the backing member 111 develops static charges, such that the disks of material cut out of the backing member 111 to form the holes 114 cling to the backing member 111. This results in substantial difficulty in making the display strip 110, and in considerable scrap. The display strips 110 have been wound longitudinally into rolls having a width equal to the display strips 110, but it is desired to provide a delivery system that is easier to handle, that does not tend to fall apart as sections of the roll slip sideways off the roll, and that does not give a preformed bend to a length of the display strip.

DETAILED DESCRIPTION OF PREFERRED EMBODIMENTS

Figure 3:
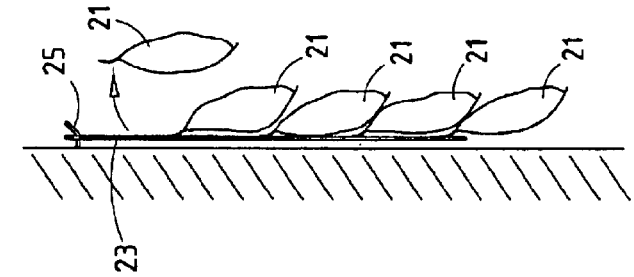
FIG. 3 is a side view of a display strip including a plurality of packages attached to the illustrated display strip.
Figure 1:
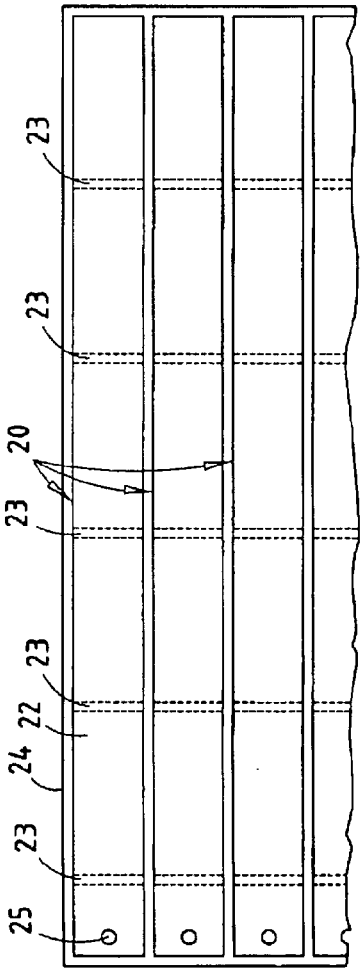
FIG. 1 is a plan view of a roll of display strips embodying the present invention.

A display strip 20 (FIG. 1) for packages 21 includes an elongated backing member 22 and several spaced-apart transverse adhesive strips 23 that extend completely across the backing member 22 for adheringly releasably holding individual packages 21. A plurality of the display strips 20 can be adhered transversely to a roll 32 of release paper 24 in a side-by-side arrangement. This allows the adhesive strips 23 to form a substantially continuous strip of adhesive 23 running parallel the length of the roll, and also allows the display strips 20 to be presented one by one as the roll is unwound a short distance equal to a width of the display strips 20. Due to the short distance of the roll as it is unwound, it allows the display strips 20 to be easily removed one at a time off an end of the roll. Also, the display strips 20 do not take on a longitudinally curved shape along their length, since the display strips 20 are held in a substantially flat condition on the roll 32, as discussed below. It is noted that the present packages 21 are illustrated to be small bags of potato chips, however the present invention can be used in and on many different products, including other food items as well as non-food items.

The illustrated display strip 20 is about 1½ inches wide and about 23 inches long. The adhesive strips 23 are about ⅜-inch wide and extend transversely completely across the backing member 22. The illustrated adhesive strips 23 are spaced apart about every 4 inches, and are about 2 inches from the top, but any spacing can be made depending upon the particular application of use for the display strip. A hole 25 is located in the top for attaching (hanging) the display strip 20 to a wall or end panel of a store shelf system.

Due to the orientation of the adhesive (i.e. the alignment of the adhesive strips 23 parallel a length of the roil 32 of release paper), the present arrangement lends itself to automated manufacture of the display strips in high volume, and further it conserves the amount of adhesive used since the adhesive only need be applied to the width and spacing desired. Further, the roll 32 is easy to handle, since it is 20 or more inches wide, instead of only 1 to 2 inches wide. Also, since the display strips 20 only extend an inch or two around the circumference of the roll 32, instead of twenty or more inches around the circumference of the roll, the display strips 20 don't tend to bunch up and/or pull free from the release paper 24. This is because, as a double layer of thin flat items are wound up into a roll, the inner layer winds around a slightly smaller diameter than the outer layer on each successive winding, causing the outer layer to generate shear forces on the inner layer and resulting in either slippage on the inner layer or bunching up of the inner layer. Bunching and separation of the adhesive material from the release paper 24 is not good, particularly where an adhesive material is used that is intended to dry out over a period of time, such as less than 24 hours of exposure to air.

The material of backing member 22 and the adhesive material of adhesive strips 23 are readily available from suppliers in the market place, and it is not necessary to specify particular products for the same, since persons of ordinary skill in this art will be able to find such materials without extensive searching and testing. Though the adhesive material is available, it is believed to be novel and unobvious to use adhesive material on a display strip that will "dry out" after several hours when exposed to air, since stores like to reuse display strips. Nonetheless, this kind of adhesive permits better control over subsequent use of the display strips 20 in the marketplace, after the original packages are removed.

Figure 2:
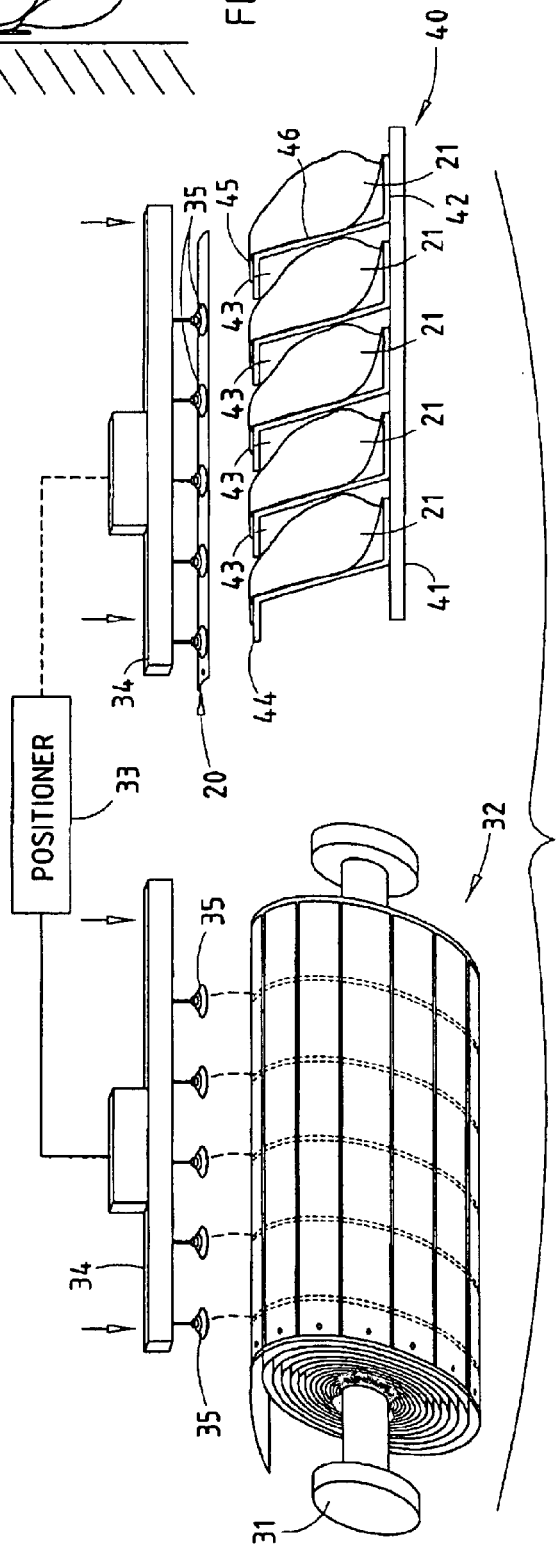
FIG. 2 is a perspective view of an automated apparatus and method for assembling packages to display strips taken from the roll.

The apparatus 30 for automatic assembly of packages 21 onto a display strip 20 is shown in FIG. 2. The apparatus includes an unroller 31 that is controlled for stepped unrolling of the roll 32 of release paper 24, each step being about equal to a width of the display strips 20. The apparatus 30 also includes a controlled positioner 33 that controls a mandrel 34. The mandrel 34 includes several suction cups 35 adapted to grip individual display strips 20 in nonstick locations and remove them individually from the roll 32. The positioner 33 includes an arm or other mechanism for moving the selected display strip 20 into alignment with packages 21 held by a holder 40.

The holder 40 includes a base 41 and a plurality of Z-shaped brackets 42 forming spaces 43 for receiving packages 21 slid into the spaces 43 from a side. The Z-shaped brackets 42 include a top panel 44 shaped to support a top flap 45 of the packages 21, and include an angled middle panel 46 that orients the packages 21 at an angle so that the flaps 45 are properly positioned. The positioner 33 positions the display strip 20 so that the adhesive strips 23 are aligned with the flaps 45 in packages 21 in the holder 40, and lowers the display strip 20 so that the adhesive strip 23 adheres to associated ones of the flaps 45. The assembly of the display strip 20 with adheringly attached packages 21 can then be slid sideways out of the holder 40 and placed into a box for shipping. Since the roll 32 is unwound at a relatively slow rate due to the transverse orientation of the display strips 20 on the roll 32, and since the display strips 20 are presented in a controlled rate, and since the packages 21 and selected display strip 20 are secure and handled in a reliable, repeatable manner, the process can be easily automated with good accuracy and speed. This is seen to be a tremendous advantage of the present apparatus.

It is to be understood that variations and modifications can be made on the aforementioned structure without departing from the concepts of the present invention, and further it is to be understood that such concepts are intended to be covered by the following claims unless these claims by their language expressly state otherwise.

We claim:

1. A product comprising:

a roll of release paper having a length and side edges and not having any lateral slits in the side edges; and a plurality of elongated display strips, each display strip having two edges defining a width therebetween and including an elongated backing member that extends perpendicular to the length of the release paper and including a plurality of spaced-apart adhesive strips that extend across each backing member in a direction parallel to the length of the release paper, the plurality of elongated display strips being positioned in a side-by-side arrangement on the roll with the adhesive strips engaging the release paper and the backing member such that the display strips are presented one at a time as the roll is unwound a distance about equal to the width of one of the display strips, the adhesive strips on each display strip all being completely exposed when the display strips are removed from the roll.

2. The product defined in claim 1, wherein the display strips each have a length of at least 18 inches and a width of about 1 inch to 2 inches.

3. The product defined in claim 1, wherein the display strips only include the backing member and the adhesive material.

4. A product comprising:

a roll of release paper having a length; and a plurality of elongated display strips, each display strip having two edges defining a width therebetween and including an elongated backing member that extends perpendicular to the length of the release paper and including a plurality of spaced-apart adhesive strips that extend across each backing member in a direction parallel to the length of the release paper, the plurality of elongated display strips being positioned in a side-by-side arrangement on the roll with the adhesive strips engaging the release paper and the backing member such that the display strips are presented one at a time as the roll is unwound a distance about equal to the width of one of the display strips, wherein the adhesive strips each include adhesive material that loses its tackiness when exposed to air over an extended period of time.

5. The product defined in claim 4, wherein the extended period of time is less than 24 hours.

6. A continuous roll of product comprising:

a continuous roll of sheet material having a release surface on one side, the continuous roll having a length and a width;

a plurality of adhesive strips on the release surface, each of the adhesive strips being elongated in a direction parallel to the length of the continuous roll, the adhesive strips further being spaced apart across the width of the continuous roll; and a plurality of elongated backing members engaging the adhesive strips, the backing members each having a strip length extending at an angle to the length of the continuous roll and further having opposing edges that define a strip width, each one of the opposing edges of an associated backing member being positioned adjacent one of the opposing edges of an adjacent one of the backing members on the continuous roll, the adhesive strips extending between the opposing edges and across each backing member;

each backing member and the adhesive strips attached thereto forming a display strip that is removable from the continuous roll;

whereby the display strips are presented one by one in a transverse position as the roll is rotated a distance equal to the strip width of the display strips, allowing the display strips to be removed one at a time off the roll with the roll having to rotatingly move only a distance equal to the strip width, wherein the adhesive strips each include adhesive material that loses its tackiness when exposed to air over an extended period of time.

7. The continuous roll defined in claim 6, wherein the extended period of time is less than 24 hours.

8. A continuous roll of product comprising:

a continuous roll of sheet material having a release surface on one side, the continuous roll having a length and a width and not having any lateral slits therein;

a plurality of adhesive strips on the release surface, each of the adhesive strips being elongated in a direction parallel to the length of the continuous roll, the adhesive strips further being spaced apart across the width of the continuous roll; and a plurality of elongated backing members engaging the adhesive strips, the backing members each having a strip length extending at an angle to the length of the continuous roll and further having opposing edges that define a strip width, each one of the opposing edges of an associated backing member being positioned adjacent one of the opposing edges of an adjacent one of the backing members on the continuous roll, the adhesive strips extending between the opposing edges and across each backing member;

each backing member and the adhesive strips attached thereto forming a display strip that is removable from the continuous roll with the adhesive strips on each display strip all being completely exposed when the display strips are removed from the roll;

whereby the display strips are presented one by one in a transverse position as the roll is rotated a distance equal to the strip width of the display strips, allowing the display strips to be removed one at a time off the roll with the roll having to rotatingly move only a distance equal to the strip width.

9. The continuous roll defined in claim 8, wherein the angle is perpendicular to the length of the continuous roll.

10. The continuous roll defined in claim 8, wherein the strip width is about 1 to 2 inches.

11. The continuous roll defined in claim 8, wherein the strip length is at least about 18 inches.

12. The continuous roll defined in claim 8, including at least four of the adhesive strips.

13. The continuous roll defined in claim 8, including a feature on the backing members for hanging each of the display strips located at one end of each of the display strips.

14. The continuous roll defined in claim 13, wherein the feature includes a hole.

15. The continuous roll defined in claim 8, wherein each one of the display strips includes only a single one of the backing members and the adhesive strips engaging the same.

16. The continuous roll defined in claim 15, wherein the display strips each have a length of at least 18 inches and a width of about 1 inch to 2 inches.

17. A continuous roll of product comprising:

a roll of sheet material defining a longitudinal direction and a transverse direction that is perpendicular to the longitudinal direction, the roll having a release surface on one side; and a plurality of display strips attached to the roll, each one of the elongated display strips including a backing member that is elongated and that extends across the roll at an angle to the longitudinal direction and further including a plurality of spaced-apart adhesive strips that extend completely across the backing member between opposing edges of the backing member, each one of the display strips being limited to only one backing member and to the plurality of adhesive strips that extend thereacross, the adhesive strips on each display strip all being completely exposed and ready for multiple prepackaged product units to be attached thereto when the display strips are removed from the roll.

* * * * *